US010634009B2

(12) United States Patent
Summers et al.

(10) Patent No.: US 10,634,009 B2
(45) Date of Patent: Apr. 28, 2020

(54) DATUM POSITIONING IN DIES

(71) Applicant: ROLLS-ROYCE plc, London (GB)

(72) Inventors: Timothy J Summers, Nottingham (GB); David Savings, Nottingham (GB)

(73) Assignee: ROLLS-ROYCE plc, London (GB)

( * ) Notice: Subject to any disclaimer, the term of this patent is extended or adjusted under 35 U.S.C. 154(b) by 207 days.

(21) Appl. No.: 15/596,687

(22) Filed: May 16, 2017

(65) Prior Publication Data

US 2017/0356307 A1 Dec. 14, 2017

(30) Foreign Application Priority Data

Jun. 8, 2016 (GB) ..... 1609988.9

(51) Int. Cl.

| | |
|---|---|
| ***B21D 43/00*** | (2006.01) |
| ***B21D 53/78*** | (2006.01) |
| ***F01D 25/24*** | (2006.01) |
| ***B21D 22/02*** | (2006.01) |

(52) U.S. Cl.

CPC ..... *F01D 25/24* (2013.01); *B21D 22/022* (2013.01); *B21D 43/003* (2013.01); *B21D 53/78* (2013.01); *F05D 2230/40* (2013.01)

(58) Field of Classification Search

CPC ..... F01D 25/14; F01D 21/045; F01D 25/26; F01D 25/24; F16M 1/00; B21D 53/78; B21D 43/003; B21D 22/022; B21D 28/04; B21D 28/265; B21D 43/26; B21D 43/023; F05D 2230/40; C21D 2201/02

See application file for complete search history.

(56) References Cited

U.S. PATENT DOCUMENTS 2,958,362 A * 11/1960 Oliver Creek ..... B21D 53/78 29/423
3,845,651 A * 11/1974 Vau ..... B21D 53/78 72/332
5,083,371 A * 1/1992 Leibfried ..... B23P 15/04 228/157

(Continued)

FOREIGN PATENT DOCUMENTS

EP 1 970 136 A1 9/2008
EP 1970136 A1 * 9/2008 ..... B21D 22/21

(Continued)

OTHER PUBLICATIONS

Oct. 17, 2017 Search Report issued in European Patent Application No. 17171309.

(Continued)

*Primary Examiner* — Lawrence Averick
(74) *Attorney, Agent, or Firm* — Oliff PLC

(57) ABSTRACT

An assembly for hot forming a component includes first and second location features reversibly attached to a sheet metal element that forms the component. The assembly is loaded into a high temperature forming rig by loosely locating the location features into corresponding datum features in a forming tool. As the assembly heats up, the location features locate accurately with the datum features. Thus, the assembly can be accurately located onto the tool accurately and with minimal opening of the hot forming rig, thereby improving efficiency and safety.

13 Claims, 6 Drawing Sheets

(56) References Cited

U.S. PATENT DOCUMENTS

| | | | | |
|---|---|---|---|---|
| 5,300,159 | A * | 4/1994 | Petzoldt | B21D 37/01 148/421 |
| 6,837,087 | B2 * | 1/2005 | Kleber | B21D 26/055 428/571 |
| 7,757,536 | B2 * | 7/2010 | Ichikawa | B21D 22/21 72/419 |
| 2004/0050128 | A1 * | 3/2004 | Kleber | B21D 26/055 72/60 |
| 2008/0111385 | A1 * | 5/2008 | Haneda | B60R 19/023 293/102 |
| 2008/0223105 | A1 * | 9/2008 | Ichikawa | B21D 22/21 72/420 |
| 2012/0174384 | A1 * | 7/2012 | Leconte | B21D 11/14 29/558 |

FOREIGN PATENT DOCUMENTS

| | | | |
|---|---|---|---|
| EP | 2295164 | A2 | 3/2011 |
| JP | 2001-321864 | A | 11/2001 |
| JP | 2006-224105 | A | 8/2006 |
| JP | 2012-236199 | A | 12/2012 |

OTHER PUBLICATIONS

Nov. 30, 2016 Search Report issued in British Patent Application No. GB 1609988.9.

* cited by examiner

DATUM POSITIONING IN DIES

CROSS-REFERENCE TO RELATED APPLICATIONS

This specification is based upon and claims the benefit of priority from UK Patent Application Number 1609988.9 filed on 8 Jun. 2016, the entire contents of which are incorporated herein by reference.

BACKGROUND

1. Field of the Disclosure

Aspects of the present disclosure relate to an assembly and/or method for forming a component, for example hot forming a metallic component.

2. Description of the Related Art

Hot forming is used in the manufacture of various metallic components, for example in the aviation industry. Such hot forming process may be hot creep forming or super plastic forming, for example. Such a hot forming processes generally involve loading a metallic assembly, such as a sheet metal assembly, into a pre-heated rig containing a forming die.

It is important to be able to locate the assembly onto the forming die accurately so that the correct shape is formed, for example so that near net shapes can be formed and/or so as to facilitate other processes, such as accurate positioning of a weld track. Datum projections have been provided onto forming dies, and holes have been cut into sheet metal assemblies with the intention of locating the datum projections into the holes in order to locate the sheet metal assembly.

However, when the sheet metal assembly is loaded into the pre-heated rig, it is smaller than after it has heated up to the temperature of the rig (which may be around 900 degrees C., for example), due to thermal expansion at higher temperatures. Thus, when the sheet metal assembly is initially loaded onto the forming die, the cut holes do not align with the datum projections.

Accordingly, it is necessary to load the sheet metal assembly into the rig into approximately the correct position, close the rig in order to allow the sheet metal assembly to heat up to the temperature of the rig and thereby expand, then re-open the rig so as to be able to manually re-position the sheet metal assembly so that the cut holes are aligned with the datum projections. It is necessary to take into account the thermal expansion of the sheet metal assembly in order to cut the holes in the correct position in the cold assembly such that they will be accurately positioned once the assembly has been heated to the rig temperature. It is then necessary to accurately cut the holes, for example using a laser cutter, so that they precisely align with the datum projections once the assembly reaches the rig temperature.

Thus, each forming operation requires the rig to be opened and closed twice just in order to load the sheet metal assembly. As well as being time consuming and labour intensive, this also means that the rig cools to below its operating temperature twice as a result of being opened. This is inefficient in terms of energy, cost, and time as it may typically take around 30 minutes for the rig to return to is operating temperature after it has been opened.

Furthermore, manual handling of the sheet metal assemblies onto the datum projections is both difficult and dangerous. The operators are required to get close to the forming die inside the rig, both when initially loading the sheet metal assembly into the rig, and particularly when repositioning the sheet metal assembly onto the datum projections once its temperature has been raised inside the rig. The extremely high temperatures involved present considerable risk to the operators, who can typically only safely maintain the required close proximity for 5 to 10 seconds.

SUMMARY

It is desirable to improve such methods of manufacture, for example by reducing or eliminating any one or more of the drawbacks or disadvantages described above.

According to an aspect, there is provided an assembly for forming a component comprising:

- a base element from which the component is to be formed; and
- a location feature for locating the base element into a datum feature in a forming tool, wherein
- the location feature protrudes from the base element so as to be locatable into the datum feature.

Such an assembly may solve or alleviate any one or more of the issues outlined above relating to loading assemblies, such as metallic assemblies, into rigs. For example, the relatively cold (for example cold relative to the rig, such as at room temperature) assembly may be loaded into a high-temperature rig with the location feature located into its respective datum feature in a forming tool. Initially, with the loaded assembly being at a lower temperature than the forming tool, the respective location and datum features may fit together loosely. However, as the assembly (including the base element and the location feature) is heated in the rig it expands, such that the respective location and datum features locate accurately relative to each other (for example engage and/or fit tightly), thereby accurately positioning and/or locating the assembly in the rig and/or on the tool. The accurate location of the assembly may occur, for example, when the assembly reaches the desired forming temperature, which may be the temperature of the rig.

The assemblies and/or methods described and/or claimed herein may allow accurate location of the assembly and/or base element with improved efficiency (for example lower energy and/or time requirements) and/or lower risk to operators. The assemblies and/or methods described and/or claimed herein may allow the assembly and/or base element to be accurately located in the tool and/or rig without requiring the rig to be opened more than once.

As referred to herein, the rig (or high-temperature forming rig) may be an enclosure in which the forming tool (and, during forming, the assembly) is contained. The rig (or enclosure) may be heated in use (for example by a heating element), thereby heating any components therein, such as the forming tool and/or the assembly. The rig (or enclosure) may be referred to as an oven.

The location feature may be metallic, for example. The location feature may be metallic regardless of the material of the rest of the assembly (such as the base element), for example.

The component to be formed may be any suitable material, such as a metallic component, a polymer and/or a composite (such as a ceramic matrix composite, or CMC). The base element may be a metallic base element. The base element may be in the form of a sheet element. The base element may be a sheet metal element.

The location feature may be reversibly attached to the base element such that it can be attached to the base element prior to a hot forming operation, and removed after the hot forming operation.

The assemblies and/or methods described and/or claimed herein may facilitate automation of locating the assembly into the rig and/or onto the tool. For example, it may allow the assembly to be located into the same position relative to the tool and/or rig, with the precise position being determined as the temperature of the assembly rises such that the location feature(s) and their respective datums accurately engage.

As used herein, the term "reversibly attached" may mean that the location feature(s) can be removed without causing damage or deformation, for example to either the location feature itself or to the base element. The location feature(s) may be re-usable. The location feature(s) may be described as being removably attached or releasably attached to the base element.

The location feature may be a first location feature, and the datum feature may be a first datum feature. The assembly may further comprise a second location feature for locating the base element into a second datum feature in the forming tool.

The assembly may be provided with any suitable number of location features, for example one, two, three or more than three. Any one or more location feature(s) of a given assembly may be as described and/or claimed herein.

According to an aspect, there is provided a method of hot forming a component. The method comprises:

opening a pre-heated high-temperature forming rig containing a pre-heated forming tool;

loading an assembly as described and/or claimed herein into the opened forming rig by locating the location feature into a corresponding datum feature in the forming tool;

closing the forming rig;

allowing the component to form at high temperature in the forming rig; and re-opening the forming rig and removing the formed component from the forming rig.

According to an aspect, there is provided a method of hot forming a component. The method comprises:

reversibly attaching a location feature to a base element from which the component is to be formed, the location feature protruding from the base element, the location feature and the base element forming an assembly;

opening a pre-heated high-temperature forming rig containing a pre-heated forming tool;

loading the assembly into the opened forming rig by locating the location feature into a corresponding datum feature in the forming tool;

closing the forming rig;

allowing the component to form at high temperature in the forming rig; re-opening the forming rig and removing the formed component from the forming rig; and removing the location feature from the formed component.

Such a rig may be, for example, a super plastic forming rig or a creep forming rig. The rig may be at any suitable temperature, for example depending on the forming process being used and/or the materials being formed. Purely by way of example, the temperature of the forming rig may be in the range of from 500 degrees C. to 1200 degrees C., for example from 700 degrees C. to 1000 degrees C., for example on the order of 900 degrees C., although it will be appreciated that rigs having temperatures outside these ranges are also within the scope of the present disclosure.

The component being formed may be a metallic component. The base element may be a sheet metal element.

The step of removing the location feature from the formed component may be performed by reversing the process used to reversibly attach the respective location feature to the base element.

The forming rig may remain closed from after the assembly has been loaded into it until it is re-opened for removal of the formed component.

The assembly may be loaded into the forming rig at a lower temperature than that inside the rig (for example it may be loaded substantially at room temperature). The location feature may expand so as to engage with and accurately locate in the corresponding datum feature as the temperature of the assembly rises inside the rig. The location feature may move relative to its respective datum feature as the temperature of the assembly rises in the rig.

Any one or more of the method steps may be automated (for example, may not require real-time human intervention). Purely by way of example, the step of loading the assembly into the forming rig may be performed by a robot.

After removing the location feature from the formed component, the location feature may then be re-used for different assemblies (which may be of the same or a different design).

According to an aspect, there is provided a method of forming at least two components comprising:

hot forming a first component according to the method as described and/or claimed herein; and subsequently hot forming a second component according to the method as described and/or claimed herein, wherein:

the location feature used in the hot forming of the second component is the same location feature that was removed from the formed first component.

More than one location feature may be available for use, such that a physically different (but substantially identical) location feature may be used in an immediately subsequent forming process. The actual location feature removed from one base assembly may be used in a forming process of a later formed component (i.e. not necessarily the immediately subsequent forming process).

Any method of manufacturing one or more components described and/or claimed herein may further comprise performing at least one finishing operation on the or each formed component.

Such a finishing operation may be, for example polishing and/or joining and/or trimming the formed component.

The forming rig may be any type of forming, for example a hot creep forming rig or a superplastic forming rig. The or each component may be formed by any type of forming, such as superplastic forming or hot creep forming.

The or each component may be any suitable component. For example, the or each component may be at least a part of a fairing of a gas turbine engine, for example at least a part of a non-acoustic core fairing.

At least one location feature may extend through the base element. At least one location feature may extend away from first and second major surfaces of the base element which (as with any reference to a base element herein) may be a sheet metal element. Such first and second major surfaces may be opposing major surfaces with surface normal that point in substantially opposite directions.

The sheet metal component may be a skin-pack comprising at least two skins (for example metal skins) that are joined (for example welded) together at selected positions only prior to the forming process.

At least one location feature may comprise a lifting eye arranged to be used to lift the assembly, for example for lifting the assembly in the rig. Such a lifting eye may be arranged to receive any type of lifting device such as, for example, a bar that may be arranged to slot through such an eye. The term lifting eye as used herein may cover any feature (for example any dedicated feature) used to lift the assembly, including, for example a hook shape or an open hook shape, as well as a closed hook shape.

In arrangements having such a lifting eye, the lifting eye and the part of the location feature that is arranged to locate the base element into a corresponding datum feature in the forming tool may extend from opposing major surfaces of the base element. In such an arrangement, the lifting eye and the part of the location feature that is arranged to locate the sheet metal element may be said to extend in substantially opposite directions away from the base element (which, again, may be a sheet element, such as a sheet metal element). The lifting eye and the part of the location feature that is arranged to locate the base element may be separable, for example so as to be separate in an unassembled state.

At least one location feature may comprise two parts that are connected together (for example reversibly connected together) so as to be attached to (for example reversibly attached to) the base element. The two parts may be separable when not attached to the base element. For example, the first part may be a locating part for locating the assembly with the respective datum. The second part may be a lifting eye for allowing the assembly to lifted and/or manoeuvred.

At least one location feature may be reversibly attached to the base element using a pin.

At least one location feature may be reversibly attached to the base element using a clip. Such a clip may be, or may include, a wedge that may be used to clamp the location feature and the base element together.

At least one location feature may comprise two parts held together with a pin in an assembled state in which the location feature is reversibly attached to the base element.

At least one location feature may comprise two parts held together with a locking clip in an assembled state in which the location feature is reversibly attached to the base element.

At least one location feature may comprise a first part having a first thread and a second part having a second thread, the first and second threads being threaded together to form an assembled state in which the location feature is reversibly attached to the base element.

The apparatus and/or method described and/or claimed herein may be used for multiple stage hot forming processes. The same location feature(s) could be used in such a multi-stage process could be used to locate the assembly on different tools used for the different forming operations. This may be particularly advantageous where the finished product is required to have both depressed and raised forms in a same panel, for example. In order to achieve this, location features may be provided on opposing surfaces (for example top and bottom surfaces) of a panel/sheet, for example.

According to an aspect, there is provided a gas turbine engine comprising a component manufactured at least in part using a method and/or assembly as described and/or claimed herein.

The skilled person will appreciate that except where mutually exclusive, a feature described in relation to any one of the above aspects may be applied to any other aspect. Furthermore except where mutually exclusive any feature described herein may be applied to any aspect and/or combined with any other feature described herein.

BRIEF DESCRIPTION OF THE DRAWINGS

Examples will now be described by way of example only, with reference to the Figures, in which.

DETAILED DESCRIPTION OF THE DISCLOSURE

Figure 1:
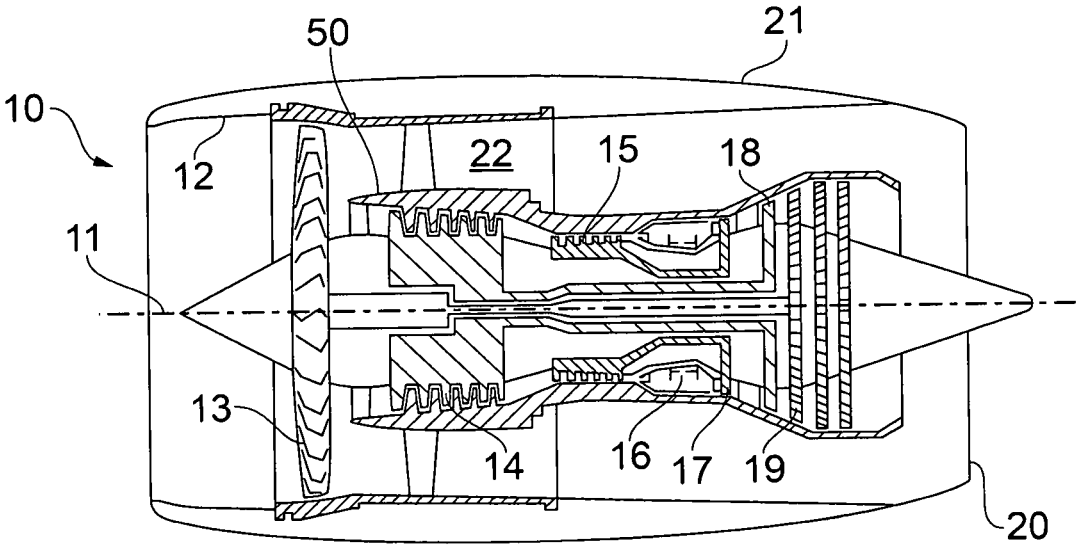
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

Various components of a gas turbine 10 engine such as that shown by way of example in FIG. 1 may be manufactured using a hot forming process. In such a process, it is generally necessary to load an assembly (comprising the material from which the component is to be formed) into a high temperature rig, such as a furnace. Purely by way of example, a component formed in this manner may be a fairing, such as a core fairing 50 (which may be a non-acoustic core fairing 50).

As mentioned elsewhere herein, conventional arrangements and methods for loading such assemblies into high temperature forming rigs have various associated problems. The method illustrated purely by way of example by the flow chart in FIG. 2 and the apparatus illustrated in FIGS. 3A to 5 may alleviate and/or substantially remove such problems, and are described in further detail below. FIGS. 3A-3F illustrate the steps used to form an assembly 100 (which may be referred to as a sheet metal assembly 100) in an assembled state. FIGS. 4 and 5 show location features 200, 300 in greater detail, in particular during reversible attachment to a sheet metal element 400 in order to form the assembly 100. The sheet metal element 400 is an example of a base element 400 as referred to elsewhere herein. Thus, the terms "base element" and "sheet metal element" may be interchangeable.

Figure 2:
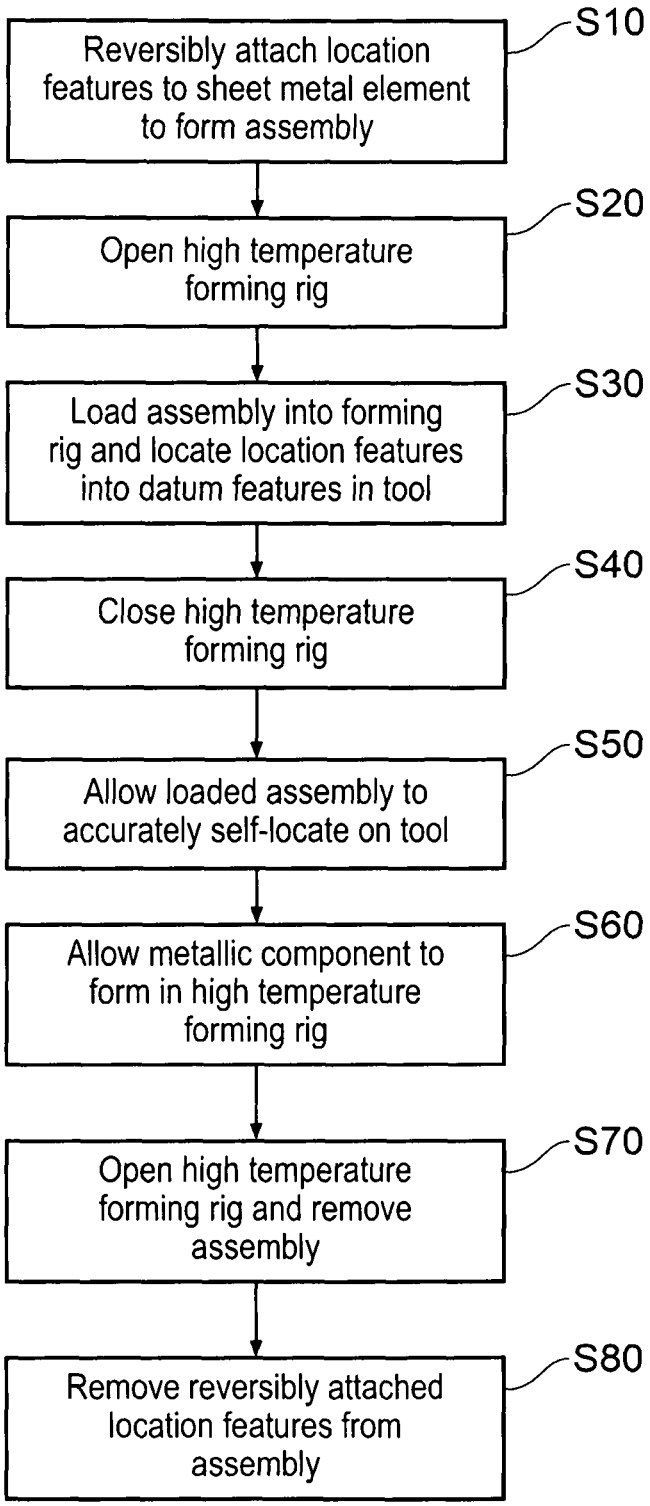
FIG. 2 is a flow diagram showing an example of a method in accordance with the present disclosure.
Figure 3A:
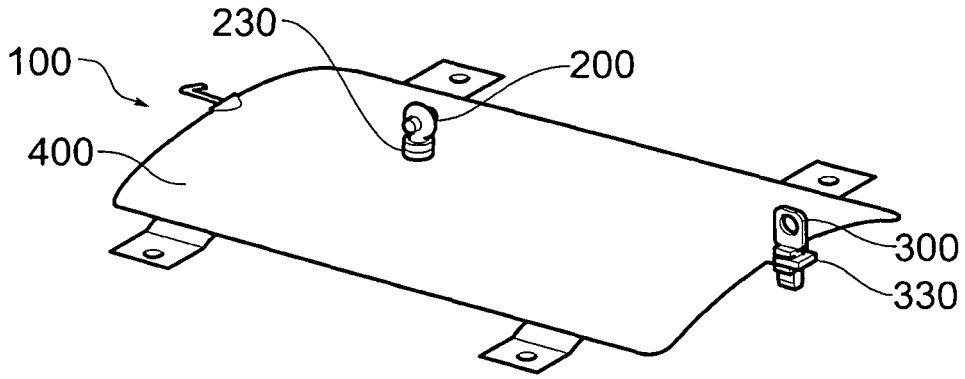
FIGS. 3A-3F are schematics that illustrate the steps used to form an assembly in accordance with an example of the present disclosure.
Figure 4:
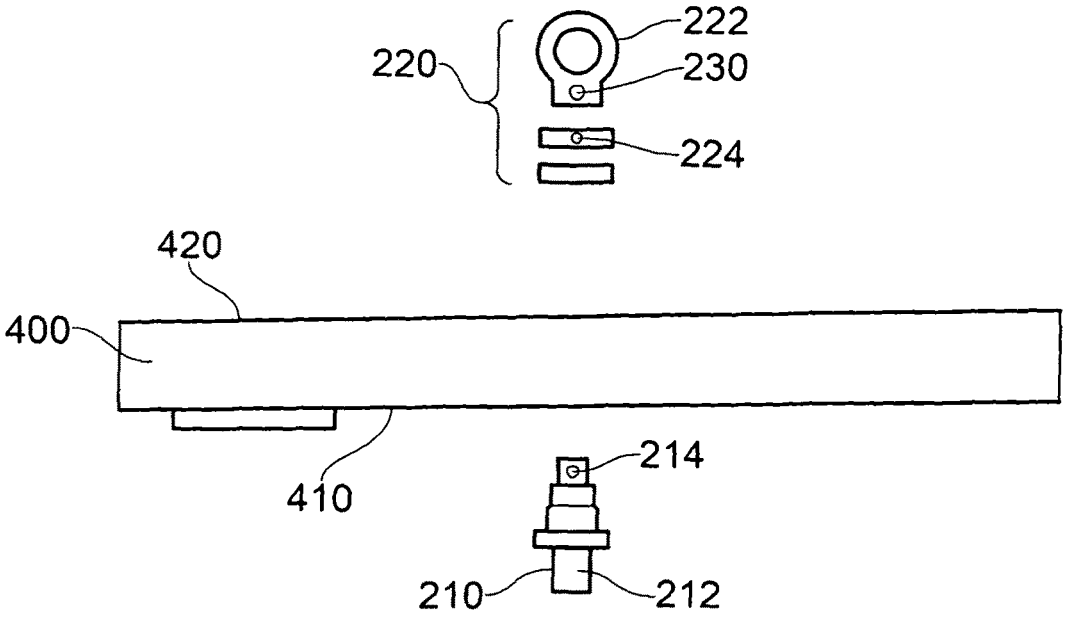
FIG. 4 is a schematic showing an example of a location feature.
Figure 5:
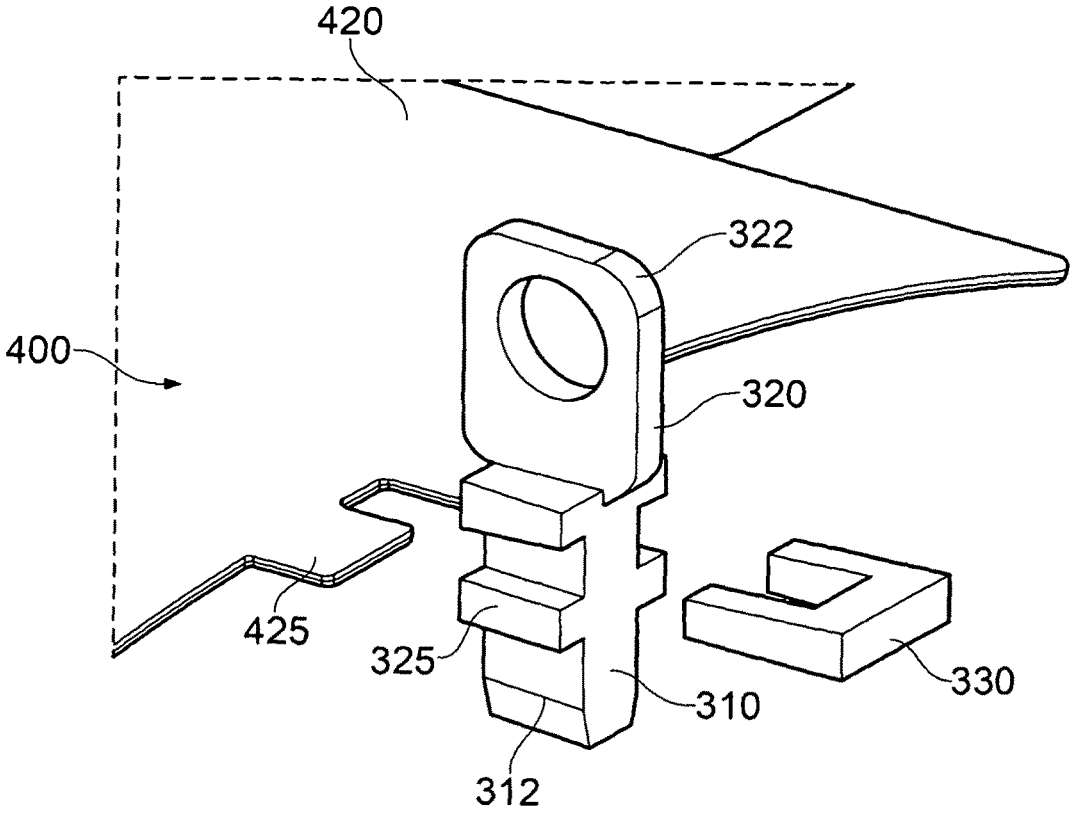
FIG. 5 is a schematic showing an example of a location feature.

Referring to FIG. 2, in step S10 the location features 200, 300 shown in FIGS. 3A, 4 and 5 are reversibly attached to the sheet metal element 400. FIG. 3A shows the location features 300, 400 attached to the sheet metal element 400, the location features 300, 400 forming an assembly. FIG. 4 shows the location feature 200 in greater detail, in an exploded view. The location feature 200 has a first part 210 on a first side 410 of the sheet metal element 400, and a second part 220 on a second side 420 of the sheet metal element 400.

A location feature may pass through the sheet metal element 400 when assembled, as shown by way of example for the location feature 200 shown in FIG. 4. In order to achieve this, the first part 210 passes through the sheet metal element 400, from the first side 410 to the second side 420. The first part 210 and the second part 220 on the second side 420. The first part 210 is then reversibly attached (or connected) to the second part 220 of the location feature 200 on the second side 420 of the sheet metal element 400. In the example shown in FIG. 4, the connection of the first part 210 to the second part 220 is achieved using a pin 230. The pin passes through a connecting hole 214 in the first part 210 and a corresponding connecting hole 224 in the second part 220, thereby reversibly attaching the first part 210 to the second part 220, and thus reversibly attaching the location feature 200 to the sheet metal element 400.

Once assembled (not shown in FIG. 4) the location feature 200 can be removed from the sheet metal element 400 (for example after the forming process is completed) simply by performing the reverse operation to that used to connected the location feature 200 to the sheet metal element 400. In the FIG. 4 example, the location feature 200 can be removed from the sheet metal element 400 by removing the pin 230 and then separating the first part 210 of the location feature 200 from the second part 220.

It will be appreciated that the pin 230 is merely one example of many connecting elements 230 that may be used to connected the first and second parts 210, 220 together (such as, for example, screw threads, pins and/or clips).

The first part 210 of the location feature 200 referred to above may be used to locate the assembly 100 into a tool 500 (as described below in relation to step S30), and so may be referred to as a locating part 210 of the location feature 200. In this regard, the first (or locating) part 210 has a location element 212. As described in greater detail elsewhere herein, the location element 212 is shaped to engage with a corresponding datum feature 510 in a forming tool 500, shown in FIG. 3C.

Figure 3B:
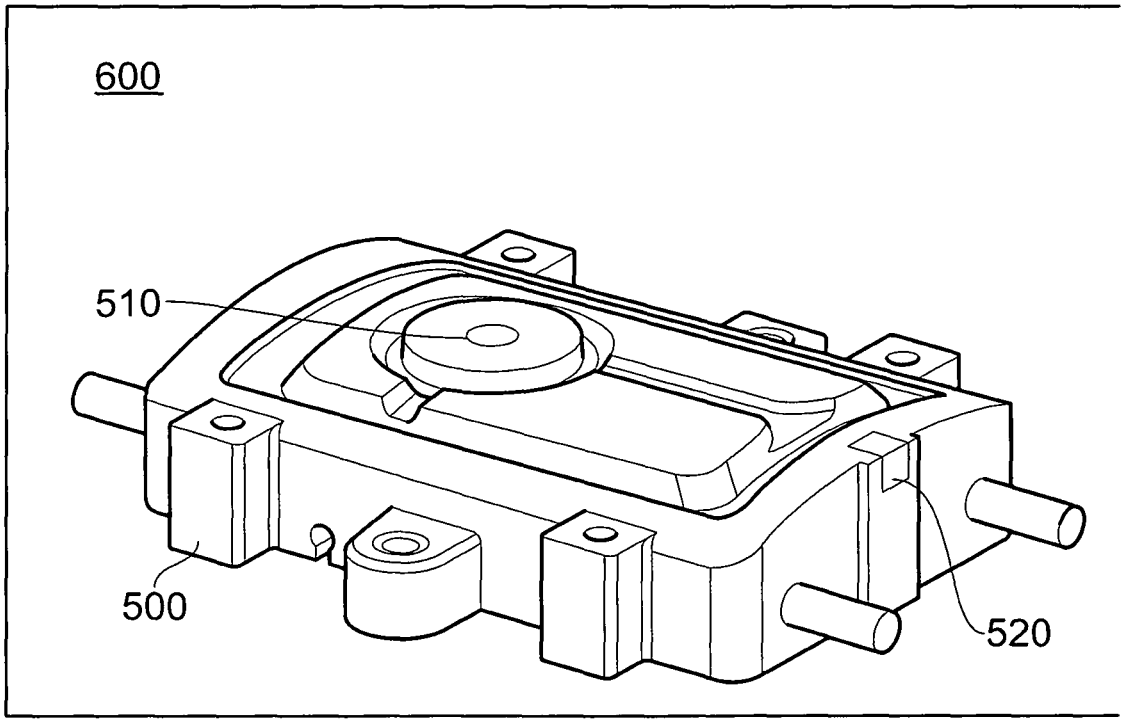
Figure 3C:
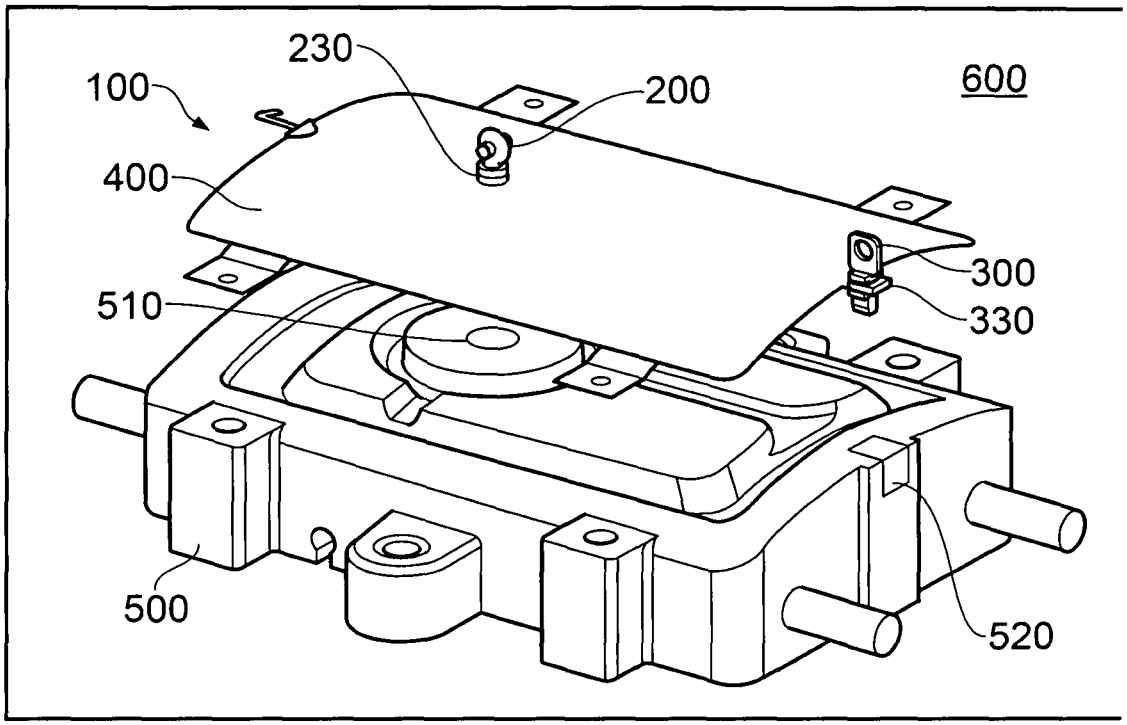

The second part 220 of the location feature 200 referred to above may be used to lift the assembly 100 onto the forming tool 500 shown in FIG. 3C, and so may be referred to as a lifting part 220. In order to achieve this, the second part 200 of the FIG. 4 example is provided with a lifting element 222, which may be referred to as a lifting eye 222. The lifting eye 222 may take any suitable form, for example any form that allows a suitable lifting tool to be used. In the FIG. 4 example, the lifting eye 220 is simply a loop into which a lifting bar may inserted in order to then lift the assembly 100.

FIG. 5 shows an alternative example of a location feature, having reference numeral 300. The location feature 300 has a first portion 310 that, when reversibly attached to the sheet metal element 400, extends away from the first major surface 410. The location feature 300 has a second portion 320 that, when reversibly attached to the sheet metal element 400, extends away from the second major surface 420. In the FIG. 5 example, the first portion 310 and the second portion 320 are integrally formed.

The exemplary location feature 300 of FIG. 5 is reversibly attached to an edge, or edge portion, of the sheet metal element 400. The location feature 300 of FIG. 5 may be said not to be surrounded by the sheet metal element 400 when it is reversibly attached thereto.

In order to reversibly attach the location feature 300 to the sheet metal element 400, a clip 330 is used. The clip 330 is used to reversibly attach an engagement portion 325 of the location feature 300 and an engagement portion 425 of the sheet metal element 400. The clip 330 may be in the form of a tapered wedge, as in the FIG. 5 example. In this example, the wedge/clip 330 can be driven into the slot formed by the engagement portions 325, 425 (to the left in FIG. 5) in order to wedge (or clamp) the location feature 300 to the sheet metal element 400.

The first portion 310 of the location feature 300 comprises a location element 312. The second portion 320 of the location feature 300 comprises a lifting element 322, which may be referred to as a lifting eye 322. The location element 312 and lifting element 322 of the FIG. 5 example may be substantially the same as the location element 212 and the lifting element 222 of the FIG. 4 example, and so will not be described in greater detail.

It will be appreciated that any suitable location feature could be reversibly attached, and those shown in detail in FIGS. 4 and 5 are merely exemplary. Furthermore, although the assembly 100 shown in FIG. 3 is provided with one location feature 200 and one location feature 300, any suitable number and type of location features may be provided, for example depending on the type (for example size and/or shape and/or material) of assembly and/or the type of component being formed (for example size and/or shape and/or material) and/or the type of forming process. Purely by way of example, an axisymmetric article may one require one location feature (although a site location feature may also be used for arrangements other than axisymmetric).

The sheet metal element 400 may be any type of sheet metal element, for example depending on the type (for example size and/or shape and/or material) of assembly and/or the type of component being formed (for example size and/or shape and/or material) and/or the type of forming process. Purely by way of example, the sheet metal element 400 may be so-called skin pack, which may have at least two metallic parts (such as sheets) seam welded and/or stich welded together. Such a skin pack 400 (or any other suitable sheet metallic element 400) may be formed into the desired shape using a super plastic forming (SPF) process.

Returning to FIG. 2, in step S20 the high temperature forming rig 600 (which may be, for example, an SPF rig)

containing a pre-heated forming tool 50 is opened as illustrated by FIG. 3B (represented schematically as the space that is not entirely surrounded by the square box that surrounds the forming tool 500 in FIG. 3B). The high temperature forming rig 600 is at an elevated temperature, such as a temperature described and/or claimed elsewhere herein. Because of the elevated temperature of the rig, any period of time that the rig is open represents a health and safety risk and/or a reduction in energy efficiency (for example due the heat energy that escapes when the rig is open) and/or a reduction in process (for example time) efficiency (for example due to the time taken for the rig to be heated back to the desired temperature). The assemblies described and/or claimed herein reduced and/or minimize the time that the forming rig is open and/or reduce the risk to human operators to the rig.

In step S30, the assembly 100 is loaded into the opened high temperature forming rig 600 as illustrated in FIG. 3C. The assembly 100 is lifted via the lifting eyes 222, 322 of the location features 200, 300. For example, lifting arms/rods may be inserted through the lifting eyes 222, 322. Such arms may be sufficiently long to minimize the risk to any human operators. Additionally or alternatively, as described in greater detail below, the arrangement of the assembly 100, for example the location features 200, 300 may allow the loading process to be automated.

The assembly 100 is loaded onto a forming tool 500, as shown by way of example in FIG. 3C. The location features 200, 300 are located with corresponding datum features 510, 520. In the illustrated example, the location features 200, 300, specifically the location elements 212, 312, are located in the corresponding datum features 510, 520 of the forming tool 500.

The temperature of the assembly 100 is significantly lower than the temperature of the forming tool 500, which has been (and is) in the high temperature rig 600.

The location features 200, 300 fit relatively loosely in the corresponding datum features 510, 520 when the much cooler assembly 100 is initially located on the forming tool 500.

The initial position of the assembly 100 relative to the forming tool 500 may be only approximately correct when initially loaded due to the relatively loose fit of the location features 200, 300 in the datum features 510, 520. This may help to make loading the assembly 100 straightforward, as it does not require precise positioning. Accordingly the time required to perform step S30 may be substantially minimized, and step S40—closing the high temperature forming rig—can be performed as soon as possible after step S20.

Figure 3D:
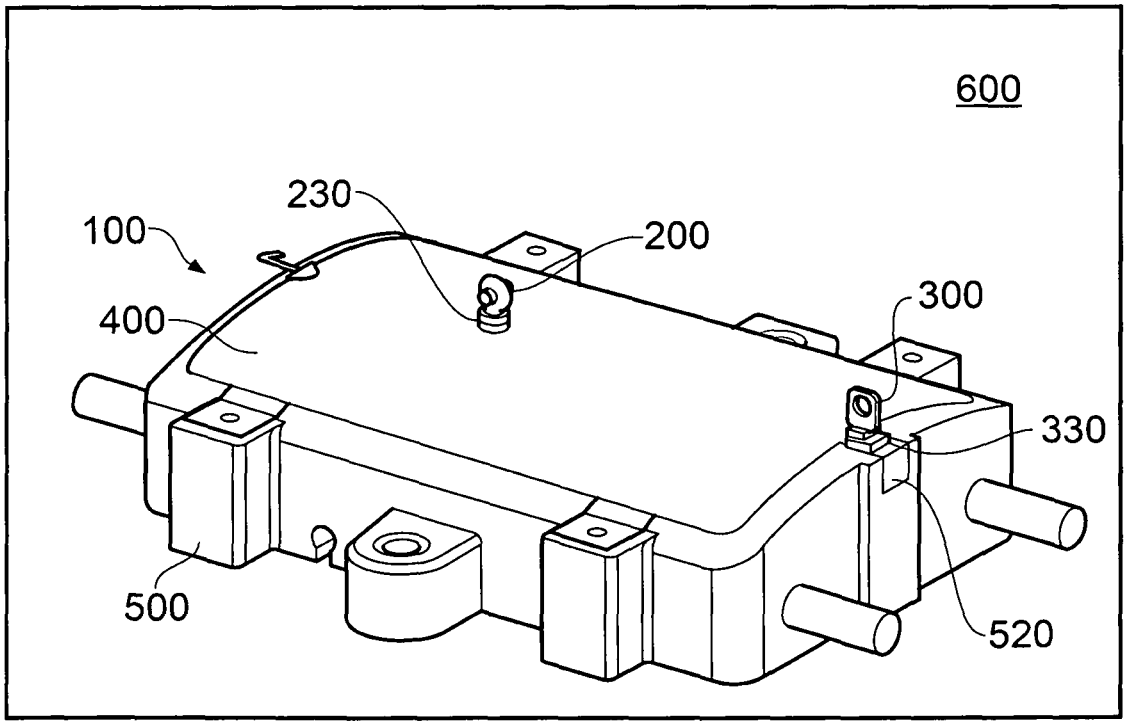

After the high temperature forming rig is closed in step S40 (represented schematically as the space defined by the square box that surrounds the assembly 100 in FIG. 3D), the temperature of the loaded assembly 100 rises. The rising temperature cause thermal expansion. As the assembly 100, including the location features 200, 300, expands, the location features 200, 300 move relative to the datum features 510, 520, for example by expanding in and/or translating relative to the datum features 510, 520. This thermal movement accurately (which may include repeatably) locates the assembly 100 relative to the tool 500, in step S50. Accordingly, the assembly 100 may be positioned only approximately during the loading step S30, but the final, forming, position of the assembly 100 relative to the tool 500 may still be accurate. The assembly 100 may be said to be self-locating on the tool 500, in that its initial location on the tool 500 may not impact the final, accurate, location. Accordingly, it may be possible to accurately locate the assembly 100 on the tool 500 without opening the high temperature rig 600 more than once.

The accurately located assembly 100 then undergoes high temperature forming in step S60. In the high temperature forming step S60, the sheet metal element 400 of the assembly 100 may be formed into a desired component (or at least into a component that can be further processed into a desired/finished component). The high temperature forming step S60 may be, for example, super plastic forming.

Figure 3E:
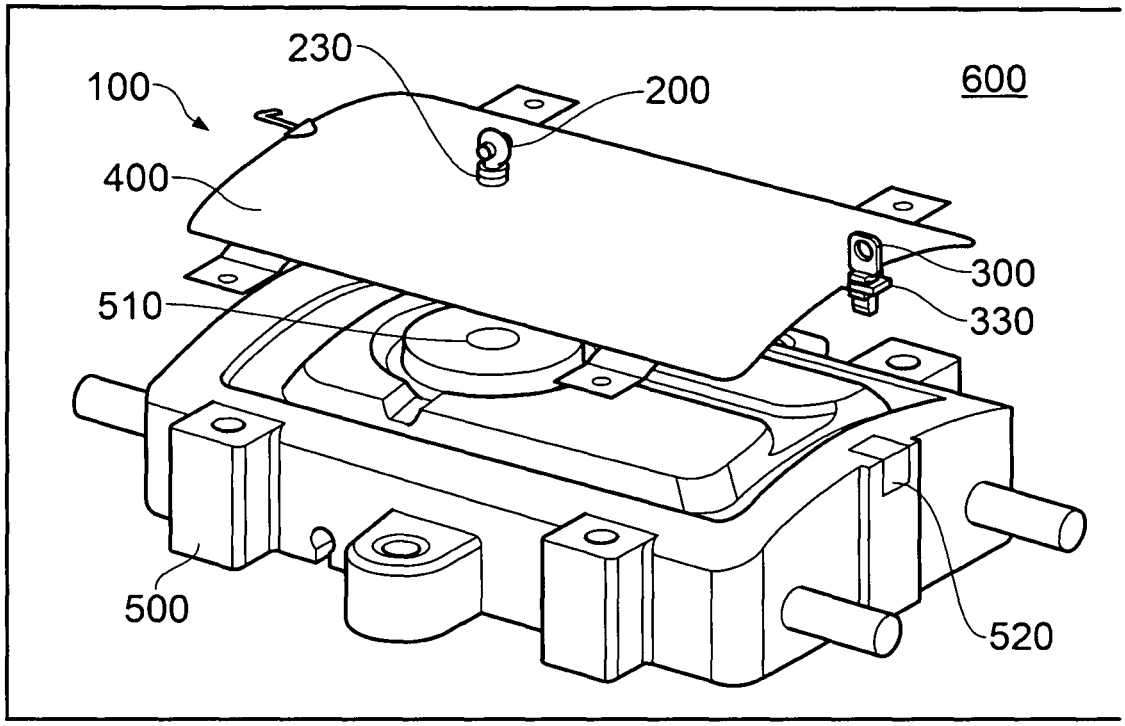

After the forming step S60 is complete, the rig 600 may be re-opened in step S70, and the formed assembly removed as illustrated in FIG. 3E. Removal of the formed assembly may be substantially the reverse of the loading step S30. Thus, for example, the removal may by performed using the lifting eyes 222, 322 and/or the removal may be automated. The opening of the rig 600 in the step S70 may be the first time that the rig 600 has been opened since it was closed in step S40 after the loading step S30.

Figure 3F:
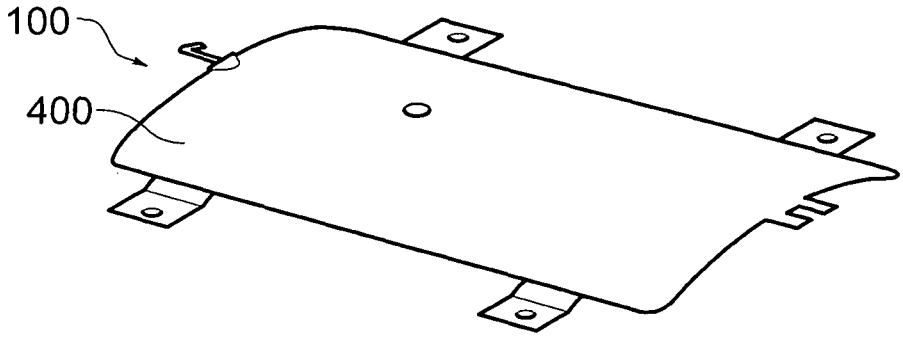

After the formed assembly has been removed in step S70, the location features 200, 300, may be removed, or detached, from the rest of the assembly in step S80, for example after the assembly has cooled as illustrated in FIG. 3F. The removal of the reversibly attached location features 200, 300 may be completed by performing the reverse process to that used to reversibly attach the location features in step S10. For example, the location feature 200 may be removed by removing the pin 230, then separating the first part 210 from the second part 220. The location feature 300 may be removed by removing the clip 330, then separating the location feature 300 from the formed component. In general the process of removing any location feature may be substantially the reverse of the process of reversibly attaching the location feature. Removed location features 200, 300 may, if required, be re-used in subsequent forming processes. Thus, for example, the location features 200, 300 removed in step S80 may be the same location features 200, 300 that are subsequently used in step S10 of a subsequent forming process.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

We claim:

1. A method of hot forming a component comprising:

reversibly attaching a location feature to a base element from which the component is to be formed, the location feature protruding from the base element, the location feature and the base element forming an assembly;

opening a pre-heated high-temperature forming rig containing a pre-heated forming tool;

loading the assembly into the opened forming rig by locating the location feature into a corresponding datum feature in the forming tool;

closing the forming rig;

allowing the component to form at high temperature in the forming rig;

re-opening the forming rig and removing the formed component from the forming rig; and removing the location feature from the formed component.

2. A method of hot forming a component according to claim 1, wherein:

the component being formed is a metallic component; and the base element is a sheet metal element.

3. A method according to claim 1, wherein the step of removing the location feature from the formed component is performed by reversing the process used to reversibly attach the location feature to the base element.

4. A method according to claim 1, wherein:

the forming rig remains closed from after the assembly has been loaded until it is re-opened for removal of the formed component.

5. A method according to claim 1, wherein:

the step of loading the assembly into the forming rig is automated.

6. A method according to claim 1, wherein:

the assembly is loaded into the forming rig at a lower temperature than that inside the rig; and the location feature expands so as to engage with and accurately locate in the corresponding datum feature as the temperature of the assembly rises inside the rig.

7. A method of forming at least two components comprising:

hot forming a first component according to the method of claim 1; and subsequently hot forming a second component according to the method of claim 1, wherein:

the location feature used in the hot forming of the second component is the same location feature that was removed from the formed first component.

8. A method of manufacturing a component according to claim 1, further comprising performing at least one finishing operation on the or each formed component wherein, optionally, at least one of the at least one finishing operations is trimming the formed component.

9. A method according to claim 1, wherein:

the or each component is formed by superplastic forming.

10. A method according to claim 1, wherein:

the or each component is at least a part of a fairing of a gas turbine engine.

11. A method of hot forming a component according to claim 1, wherein:

the location feature is a first location features that is located into a first datum feature;

the assembly further comprises a second location feature; and the step of loading the assembly into the opened forming rig further comprises locating the second location feature into a corresponding second datum feature in the forming tool.

12. A gas turbine engine comprising a component manufactured at least in part using the method of claim 1.

13. A method according to claim 1, wherein the pre-heated high-temperature forming rig and the pre-heated forming tool are both warmer than the assembly when performing the loading of the assembly into the opened forming rig.

* * * * *